United States Patent [19]

Lundström et al.

[11] 4,392,130

[45] Jul. 5, 1983

[54] METHOD AND DEVICE FOR PRESENTATION OF GRAPHICAL INFORMATION

[75] Inventors: Jan-Erik Lundström; Ingemar Rudgård, both of Västerås, Sweden

[73] Assignee: ASEA Aktiebolag, Västerås, Sweden

[21] Appl. No.: 225,228

[22] Filed: Jan. 15, 1981

[30] Foreign Application Priority Data

Jan. 16, 1980 [SE] Sweden ..... 8000346

[51] Int. Cl.[3] ..... G09G 1/16

[52] U.S. Cl. ..... 340/747; 340/709; 340/728

[58] Field of Search ..... 340/747, 709, 728

[56] References Cited

U.S. PATENT DOCUMENTS 3,731,299 5/1973 Bouchard et al. .

4,131,883 12/1978 Lundström ..... 340/750

4,131,886 12/1978 Kosuge ..... 340/52 F 4,300,136 11/1981 Tshiki et al. ..... 340/747

*Primary Examiner*—David L. Trafton

*Attorney, Agent, or Firm*—Pollock, Vande Sande & Priddy

[57] ABSTRACT

The invention relates to a method and device for generating and presenting an image on a visual display unit or some other display member. The image is composed, for example by an operator via a keyboard, of a plurality of symbols defined in advance in a symbol memory, which are placed on the image adjacent to each other. Each symbol is associated with at least one predetermined entry point and at least one predetermined exit point. When creating the image, a symbol is placed so that an entry point of that symbol is located immediately adjacent to an exit point of a previously displayed symbol.

6 Claims, 20 Drawing Figures

| | | |
|---|---|---|
| 1 | 2 | 3 |
| 4 | 5 | 6 |
| 7 | 8 | 9 |

| | | | | | | | | | | | | | | | |
|---|---|---|---|---|---|---|---|---|---|---|---|---|---|---|---|
| 0 | | | ↑ | ↓ | → | ← | 1 | 2 | 3 | 4 | 5 | 6 | 7 | 8 | 9 |
| a | b | | c | | | | d | | | | | | | | |

| | |
|---|---|
| ± Δ x | ± Δ y |

| | |
|---|---|
| 1 | ADDRESS |
| e | f |

| | | | | |
|---|---|---|---|---|
| 0 | 0 0 | 1 0 1 0 | 1 1 1 1 0 0 1 0 0 | m1 |
| 0 | 0 1 | 0 0 0 1 | 1 1 0 0 1 0 0 1 0 | m2 |
| 0 | 0 0 | 0 1 0 0 | 0 0 0 0 1 1 1 0 0 | m3 |
| 0 | 1 1 | 0 0 0 0 | 0 0 0 1 0 0 0 1 0 | m4 |

METHOD AND DEVICE FOR PRESENTATION OF GRAPHICAL INFORMATION

TECHNICAL FIELD

The present invention relates to a method for presenting graphical information in the form of an image on a display member, such as a visual display unit (VDU), on which the image is assembled from a plurality of symbols defined in advance, which symbols are displayed so as to appear connected one to another. The invention also relates to a device for carrying out the method.

A method and a device according to the invention are intended to generate an image of the symbols, preferably manually, on, for example, a VDU. One example of such an image is a circuit diagram of an electrical plant, which may be manually composed initially and then stored in a memory for re-presentation whenever required. In the case of a circuit diagram, the symbols required would consist of pictorial representations of the different components of the plant, e.g. symbols in the form of line segments, intersections or right angles, circles and circuit components such as resistors, capacitors, etc. Further a set of alphanumeric symbols (letters and figures) is also required. The symbols must be able to have a varying size and shape. Further, each new symbol used must be able to be oriented in a certain way in relation to a previously written symbol. If, as is desirable, there are several possible write directions in which the image can be displayed, this orientation becomes dependent on which particular write direction is chosen.

Generating an image of the kind mentioned above has hitherto been extremely time-consuming and, therefore, a costly operation. The invention aims to provide a method and a device which make possible a rapid and simple generation of such images.

DISCLOSURE OF THE INVENTION

According to one aspect of the present invention in a method for the presentation of graphical information in the form of an image on a display member, such as a visual display unit, VDU, on which the image is built up from a plurality of symbols each of which is defined in advance and placed on the image in correct relative relation to each other, there is provided the improvement which comprises associating each symbol with at least one predetermined entry point and at least one predetermined exit point, and locating each new symbol on the image so that an entry point of the new symbol is immediately adjacent to an exit point of a previously located symbol.

According to a further aspect of the invention a device for carrying out the method of the invention comprises an input member for feeding in information which identifies a symbol selected for the image to be presented; memory means for storing information about the configuration of the symbol and about its entry and exit points; means for the identification of an entry point of a selected symbol; and display means for displaying the symbol on the image in such a position that the said entry point is immediately adjacent to an exit point of a previously displayed symbol.

BRIEF DESCRIPTION OF DRAWINGS

The invention will now be more fully described, by way of example, with reference to the accompanying drawings, in which.

BEST MODE OF CARRYING OUT THE INVENTION

Figure 1:
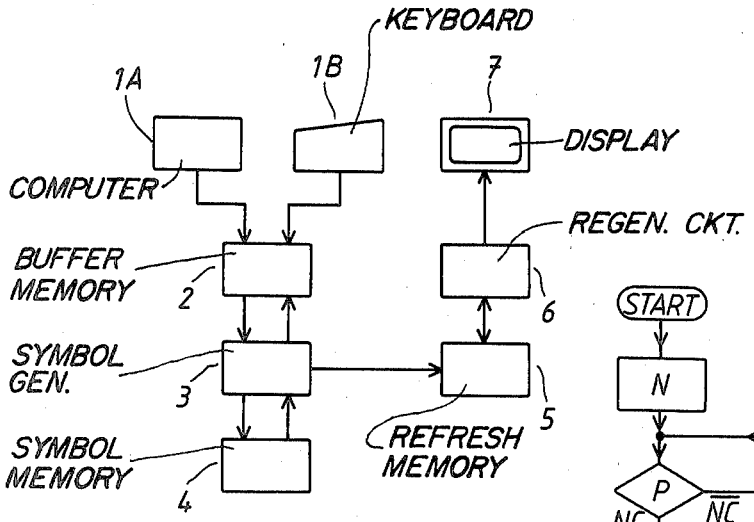
FIG. 1 is a schematic representation of a device according to the invention.

FIG. 1 shows a device for carrying out the method according to the invention and includes a VDU 7 as a display member on which each symbol (assumed in a known manner to be built up from a dot matrix which is detected/written line by line, for example according to the disclosure of U.S. Pat. No. 4,131,883) is displayed.

Two input members 1A and 1B are shown in FIG. 1. The member 1B is a keyboard by means of which the image can be generated step by step—i.e. symbol by symbol—on the VDU 7. With the aid of the keyboard 1B, information about what symbol is to be written next and the desired write direction is generated. An electronic marker or cursor (see FIG. 3*a*) may be displayed on the VDU 7 and may be manually displaced to any desired position (see FIG. 3*b*) with the aid of the keyboard 1B. Although the invention is primarily intended for manual generation of an image with the aid of the keyboard 1B, information necessary for generating the image may, of course, be obtained via the other input member 1A, for example a computer.

The information from the input members 1A, 1B is supplied via a buffer member 2 to a symbol generator 3. The symbol generator 3 processes the incoming information and, in dependence thereon and on the information from a symbol memory 4, it controls the location of the symbols and the displacement of the electronic marker.

Information about a chosen symbol is supplied to the symbol generator 3 in the form of a coded signal. The code is used to address a location in the symbol memory 4 where information about the shape, size and entry and exit points of the symbol is stored. Examples of how the symbol memory 4 may be designed are shown in FIGS. 4–8*b*.

The symbol generator 3 picks up the symbol description from the symbol memory 4 and, starting from the current write direction and marker position, calculates (a) where on the VDU 7 the symbol is to be written, and (b) where the electronic marker is to be displaced to after writing the symbol.

The symbol generator 3 transmits the symbol description and information about the location of the symbol on the VDU 7 to a refresh memory 5. In this memory 5, the complete contemporary image is stored, that is, all the previously written symbols, including the current marker position. Each new symbol is stored in the refresh memory 5 at its intended place with the entry point of the new symbol corresponding to the current marker position. Thereafter (or simultaneously) the marker is displaced to the exit point of the last entered symbol.

A regenerative circuit 6 is used to cyclically scan the refresh memory 5 and present the information stored in the memory 5 to the VDU 7, where the image is displayed.

Figure 2:
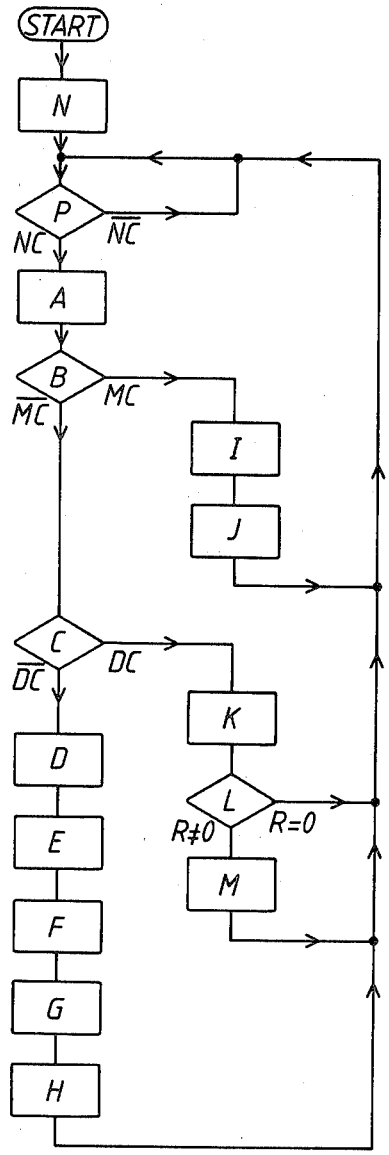
FIG. 2 is a flow diagram indicating the operating sequence for symbol generation in the device of FIG. 1, FIGS. 3*a* to 3*f* show some stages in the generation of part of a simple image in accordance with the method of the invention.

The manner in which the symbol generator 3 operates can be taken from the flow diagram in FIG. 2.

Three types of commands may be fed into the symbol generator 3 from the input members 1A/1B; these being:

(a) a "Displacement command," which orders a displacement of the electronic marker to a new position, (b) a "Write-direction command," which indicates the desired write direction at the time in question, and (c) a "Symbol code," which identifies the next symbol required for display on the VDU 7.

The symbol generator 3 operates with an auxiliary quantity (or flag) R, which may assume either the value "0" or the value "1." When R equals "1" it indicates that the marker is temporarily located at an exit point of a symbol. The designations used in the flow diagram of FIG. 2 for the different operations have the following significance:

N: Set R equal to "0" and select a certain predetermined write direction, for example horizontally to the right.

P: Is a new code fed into the buffer memory 2? If the answer is yes, an output $\overline{NC}$ is used; otherwise an output NC.

A: Pick up the code (command) from the buffer memory 2.

B: Is the code a displacement command for the electronic marker? If the answer is yes, an output MC is used; otherwise an output $\overline{MC}$.

I: Set R equal to "0."

J: Move the marker to the ordered coordinate.

C: Is the code from the buffer memory 2 a new command of write direction? If the answer is yes, an output DC is used; otherwise an output $\overline{DC}$.

K: Replace the previous write direction with the new write direction.

L: Is R equal to "0?" If the answer is yes, an output $R=0$ is used; otherwise an output $R\neq 0$.

M: Detect and move the marker to the exit point of the last written symbol that corresponds to the new write direction selected.

D: Detect the entry of a new symbol for the current write direction.

E: Write the new symbol with its entry point coincident with the marker position.

F: Detect the exit point of the new symbol that corresponds to the current write direction.

G: Move the marker to the exit point determined according to F.

H: Set R equal to "1."

After START the symbol generator 3 sets R equal to "0" and selects the predetermined write direction (operation N). Thereafter the symbol generator 3 remains inactive in the loop around P until the buffer memory 2 indicates that a new code (new command) has arrived from the input member 1A or 1B and is ready to be picked up. Depending on which of the above-mentioned three types of commands that has arrived, the flow diagram in FIG. 2 will be traversed along one of the three different paths, described below.

(a) If the command is a "Displacement command."

From the output MC of the block B, the flow path passes to the block I, where the symbol generator 3 sets R equal to "0," which indicates that the association of the marker to the exit point of the preceding symbol has been broken. In the block J, the marker is moved to the coordinate indicated in the "Displacement command." Thereafter a jump to the block P takes place, where the symbol generator 3 awaits the next command.

(b) If the command is a "Write-direction command."

If the answer in the block B is negative (i.e. the output $\overline{MC}$ is used) and the answer in the block C is positive (i.e. the output DC is used), the command is a new "Write-direction command." In the block K, the previously prevailing write direction is replaced with the new one. If R equals "0," no further processing is necessary and a jump back to the block P takes place. If R equals "1," the exit point of the last written symbol that corresponds to the new write direction is detected in the block M, and the marker is displaced to this exit point.

(c) If the command is a "Symbol code."

If the answers are negative both in the block B and in the block C, the incoming command will be a "Symbol code." The symbol, identified through the code, will then be written on the VDU 7 via the refresh memory 5 and the marker will be displaced to the proper exit point of the symbol.

In the block D, the entry point of the new symbol for the prevailing write direction is detected.

In the block E the symbol is written in the refresh memory 5 and on the VDU 7, the entry point selected in the block D then coinciding with the marker position. When writing a continuous sequence of symbols, the marker will normally be located on the exit point of the preceding symbol that corresponds to the prevailing write direction. Alternatively, however, the marker may be displaced so as not to be positioned on an exit point of a preceding symbol. When writing the first symbol of an image there is of course no preceding symbol.

In the block F, the exit point of the written symbol that corresponds to the prevailing write direction is detected, in the block G the marker is displaced to this exit point, and in the block H, R equal "1" is set, after which a jump back to the block P takes place.

Figure 3A:
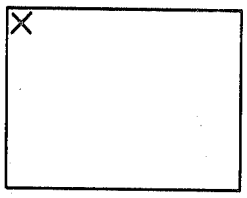

With reference to FIGS. 3*a* to 3*f*, an example of the application of the invention will now be described. It is assumed that an operator wishes to generate an image on the VDU shown in FIG. 3*f* via the keyboard 1B in FIG. 1. FIG. 3*a* shows the initial position after the command "START" has been given in FIG. 2. The marker (shown as a cross) is then automatically located in a predetermined initial position, in this case at the upper left-hand corner of the VDU 7. A predetermined write direction, in this case horizontally to the right, is then automatically selected.

Figure 3B:
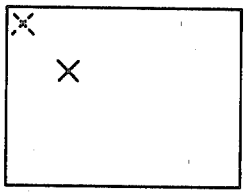

In FIG. 3*b*, the operator has fed in an appropriate "Displacement command", and the marker has been displaced to the desired starting position. The loop P-A-B-I-J in FIG. 2 has been completed, possibly a number of times. The quantity R has been set at "0," which indicates that the marker is not located at an exit point of a symbol.

Figure 3C:
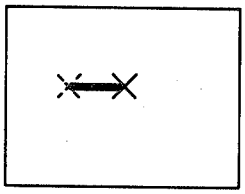

In FIG. 3c, the operator has written the symbol "horizontal line segment." This symbol is now written with its entry point (for the current write direction i.e. the left-hand end of the line segment) located at the position of the marker. The loop P-A-B-C-D-E-F-G-H-P in FIG. 2 has now been completed. The marker is displaced automatically to the exit point of the written symbol (for the current write direction, the right-hand end of the line segment), which is indicated by the quantity R being set at "1."

Figure 3D:
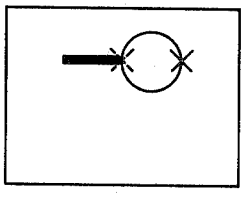

In FIG. 3d the operator has fed in a circle symbol. The same procedure as under FIG. 3c is repeated. The quantity R is still "1."

Figure 3E:
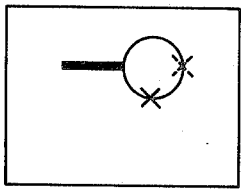

In FIG. 3e the operator has selected a new write direction, in this case vertically downwards. The loop P-A-B-C-K-L-M-P in FIG. 2 has now been completed. The quantity R was "1" and indicated that the marker was at an exit point of a symbol. The symbol generator 3 therefore detects the exit point of the last written symbol that corresponds to the new write direction and places the marker at this exit point.

Figure 3F:
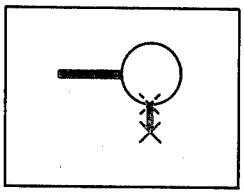

In FIG. 3f the operator has fed in the symbol "vertical line segment." The loop P-A-B-C-D-E-F-G-H-P in FIG. 2 has now been completed. After writing the symbol, the symbol generator 3 places the marker at the proper exit point for the current write direction (i.e. the lower end of the line sgement).

The operator may now continue in this way to generate the complete image, symbol by symbol. For each new symbol, the operator may either continue in the same write direction or select a new write direction. Similarly, he may choose between either continuing in immediate connection to the preceding symbol (as described with reference to FIG. 3f) or by displacing the marker to a new position spaced from the last written symbol.

Figure 4:
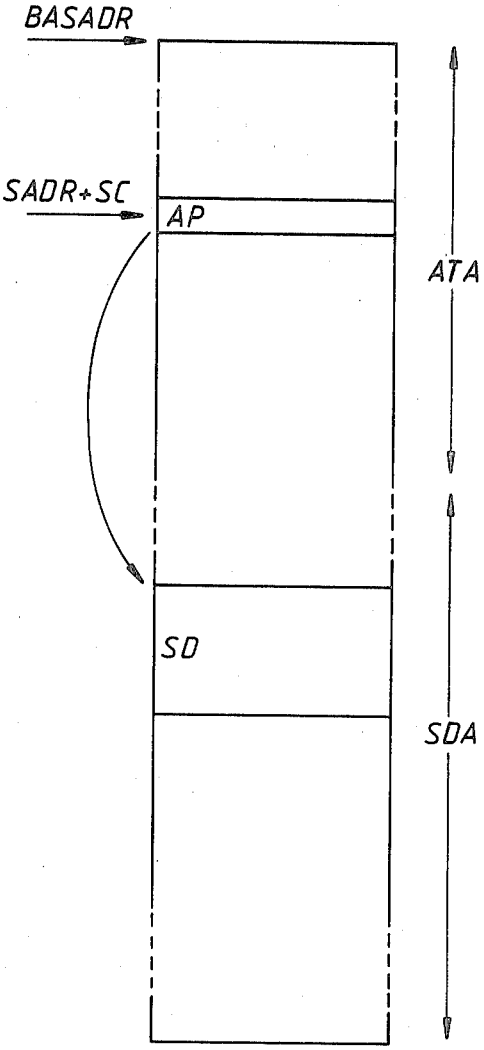
FIG. 4 shows how the symbol memory of the device of FIG. 1 may be arranged, FIGS. 5*a* to 5*d* indicate how information may be stored in the memory of FIG. 4, FIGS. 6*a* and 6*b*, 7*a* and 7*b* and 8*a* and 8*b* show three examples of symbols and the memory-stored information for generating each, and FIG. 9 indicates possible entry and exit points of a symbol in the case of different write directions.

The input member 1A or 1B delivers, among other things, symbol codes to the symbol generator 3, which symbol codes identify the symbol to be written. In the symbol memory 4, information is stored about the appearance of each symbol and about its entry and exit points for different write directions. FIG. 4 shows an example of how the symbol memory 4 may be organized. The memory 4 consists of two parts, one part being an address transformation area (ATA) and the other part a symbol description area (SDA). The address transformation area is a cross-reference table between the incoming symbol code and the symbol description area. The address ADR to a memory cell in the address transformation area ATA may be described as $$ADR = BASADR + SC$$

where BASADR is a base address, for example to the first cell of the address transformation area. An incoming symbol code SC thus gives the address to a memory cell in the address transformation area. In this cell there is stored an address pointer AP which constitutes the address to the first word or field in that part of the symbol description area which contains the description SD of the symbol in question.

FIGS. 5a to 5d show further examples of the information about a symbol that may be stored in the symbol description area SDA.

A symbol is constructed from modules with a number of fundamentally arbitrary rows and columns in each symbol. The number of columns may be different for different rows in the symbol.

A module consists of m×n image elements (pixels), where m and n are arbitrary constants. In this example and in the following examples, m=n=3, that is, each module consists of nine image elements.

Each row of modules in the symbol may start in an arbitrary module column in relation to the preceding module row. The rows need not be given in any special order in the memory, which means that, for example, empty rows may be omitted.

Figures 5A, 5B, 5C, 5D, 6A, 6B:
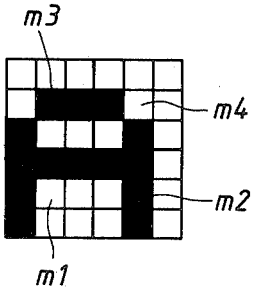

FIG. 5a shows a module which consists of nine image elements, numbered from 1 to 9.

FIGS. 5b, 5c and 5d show the formats of the fields occurring in the symbol description area SDA of the memory 4. Three different kinds of fields may occur.

The first type of field (see FIG. 5b) described the form and location of a module within the symbol. The first bit (a) in the field—a zero—indicates that the field is of this kind. The next two bits (b) are the so-called "link bits," which have the following significance:

where the "link bits" are "00" the row continues with at least one further module, where the "link bits" are "01" this module is the last module on the row, where the "link bits" are "10" a displacement is necessary where the "link bits" are "11" this module is the last module in the symbol.

The following four bits (c) correspond to the four possible write directions in the example. A "1" in any of these bits indicates that that module is the entry point for the complete symbol when the write direction is that corresponding to the bit. In the example chosen this also means that the module is the exit point for the complete symbol when using the opposite write direction.

Each one of the last nine bits (d) indicates whether the corresponding image elements (cf. FIG. 5a) of the module are to be written or not.

If the "link bits" in a symbol format field according to FIG. 5b are "10, " a displacement field is stored in the memory immediately after this symbol format field, and such a displacement field is shown in FIG. 5c. In such a displacement field Δx indicates in what column the next module of the symbol is to be located relative to the current column, and Δy indicates in what row the symbol continues relative to the current row (see the further examples in FIGS. 6–8).

The third kind of field is shown in FIG. 5d and indicates a jump in the memory. The first bit (e) indicates that the field is of this kind, and the other bits (f) contain the relative address to the field in the memory where the next module of the symbol is stored. The address=BASADR+(f) (see FIG. 4).

FIGS. 6a and 6b show, as an example, how the letter "A" may be stored in the symbol memory. FIG. 6a shows how the letter consists of four, nine element modules m1–m4. FIG. 6b shows the four fields in the symbol description area of the symbol memory. The first field is designated the definition field of the symbol and it is the address of this field that is obtained from the address transformation area of the symbol memory. The corresponding module (ml) is designated the definition module of the symbol. This field contains firstly (cf. FIG. 5b) the dot pattern of the definition module. Secondly it indicates that the module constitutes the entry point (entry module) for either of the write directions in the upward direction or the rightward direction (and the exit point or exit module for either of the two opposite write directions). Thirdly the "link bits" "00" indicate that the next module (m2) is on the same row as the module m1. The next field, which is in the following address, is the entry point for the symbol if the write direction is to the left (and the exit point of the symbol if the write direction is to the right). The "link bits" "01" in module m2 indicate that the module row is finished when this module has been written. The module (m3) in the next field in the memory will thus be located in the next-above module row and directly above the module m1. The fourth and last field includes the "link bits" "11" which indicate that this module (m4) is the last one to be written to complete the symbol.

Figure 7A:
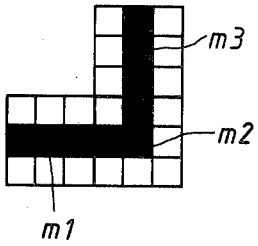
Figure 7B:
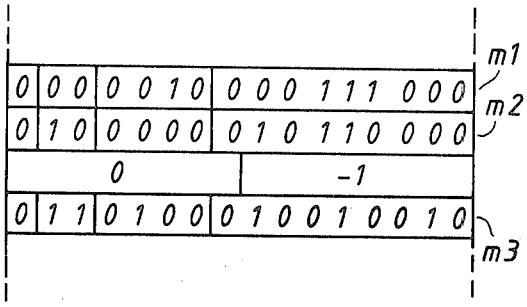

FIGS. 7*a* and 7*b* show how an angle symbol, which does not have a rectangular limiting boundary, can be written. FIG. 7*a* shows that the angle symbol consists of three modules (m1, m2, m3). FIG. 7*b* shows the four fields, belonging to the angle symbol, in the symbol description area of the symbol memory. The second field has the "link bits" "10," which indicates that the following field is a displcement field. The displacement (cf. FIG. 5*c*) is $\Delta x =$ "0" and $\Delta y = -$ "1." The displacement is always counted relative to the last module (m2) and is positive for the rightward or downward direction. The last module (m3) will thus be written in the same column as the module m2, but displaced one module interval upwards, that is, on the row above it.

Figure 8A:
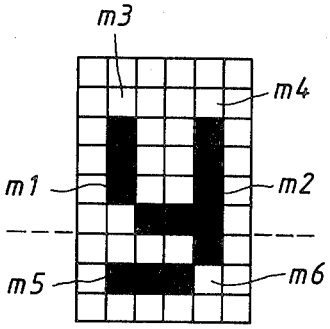
Figure 8B:
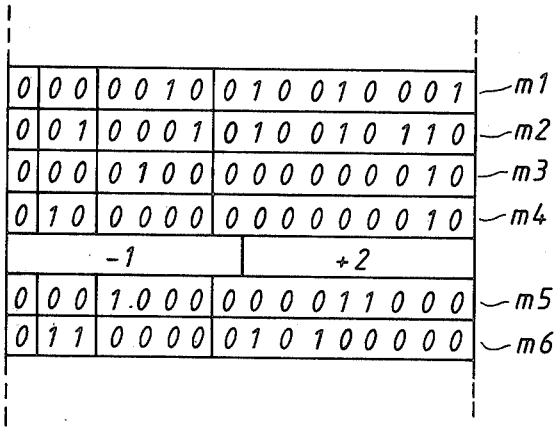

FIG. 8*a* shows a lower-case letter (a "y") which extends below the base line (shown dashed in FIG. 8*a*) on which the letters are being written. After the first four fields in the symbol memory there follows a displacement field (see FIG. 8*b*) which indicates that the next module (m5) is to be written displaced one column to the left and two rows downwards relative to the last module (m4).

In each of the symbols discussed with reference to FIGS. 6*a*, 7*a* and 8*a*, it will be noted that the fourth, fifth, sixth and seventh bits in the fields of each module indicate the entry and exit points available for the complete symbol. Thus taking the symbol "y" of FIG. 8*a* as an example, if the selected write direction is vertically upwards, module m5 must be the entry point and module m3 the exit point. Where the selected write direction is to the left, module m2 represents the entry point of the symbol and module m1 is the exit point.

Further, in accordance with the invention, the exit point of a last-written symbol must be immediately adjacent to an entry point of the next-to-be-written symbol so that, for example if a write direction to the right is selected and the symbol "A" of FIG. 6*a* is to be followed by the symbol "Y" of FIG. 8*a*, module m2 of FIG. 6*a* will abut module m1 of FIG. 8*a*.

Figure 9:
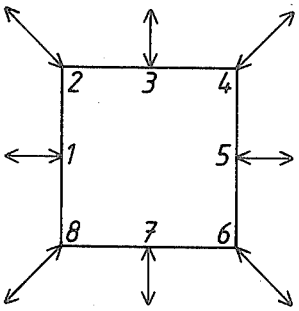

In the above-mentioned examples, it has been assumed that there are only four possible write directions and just four bits (the fourth, fifth, sixth and seventh in FIG. 5*b*) have been allocated in the field for the designation of write direction. However, the number of write directions may be arbitrary. FIG. 9 shows an example of a symbol (only the limiting boundary of which is shown) having entry and exit points for eight different write directions and if this arrangement is required, eight bits must be allocated in the field of each module to designate the various entry and exit points. For example, the point marked 4 in FIG. 9 is the entry point for the write direction in an oblique downward-leftward direction and the exit point for the write direction in an oblique upward-rightward direction.

In the above-described examples, each exit point of a symbol for a certain write direction serves as the entry point for the opposite write direction, and vice versa. However, in general, this need not be the case.

It has been described above how the information about entry and exit points is directly stored in immediate conjunction with the symbol description (FIGS. 5*b*, 6*b*, 7*b* and 8*b*). Alternatively, the information about the entry and exit points of a symbol for the different write directions may be calculated with the aid of algorithms.

It may be desired to write a certain symbol after it has been rotated by a multiple of, for example, 90° in relation to a basic position. To reduce the demands on the memory it may then be convenient to store the symbol configuration only once and obtain a rotational transformation of the symbol by moving the entry and exit points.

It has been described above how a VDU is used as a means of presentation. The invention may also be applied in connection with other types of display members, for example a coordinate recorder or a typewriter.

The various units in a device according to the invention may consist of conventional electronic components (memory circuits, logic circuits, etc.) which provide the functions mentioned above. Alternatively, the functions of the units may wholly or partially (for example, the logic functions of the symbol generator 3) consist of a processor or computer which is programmed, for example, according to the flow diagram of FIG. 2.

As is clear from the above description, according to the invention an image may be generated in a rapid and simple manner by an operator direct from a keyboard. The symbols used may have arbitrary size and shape. Large characters of a certain kind (e.g. letters) may be mixed with small ones without the operator having to think about or take the charater sizes into consideration. By the simple choice of one or a plurality of possible write directions and by placing the symbols automatically in correct relative positions in dependence on the selected write direction, even very complicated images, for example complete electric circuit diagrams, may be generated in a rapid and simple manner.

What is claimed is:

1. In a system for generating a display image composed of a plurality of interconnected symbols, each of which is in turn composed of a plurality of symbol modules, wherein an entry module of a symbol is displayed adjacent to an exit module of a precedingly displayed symbol, the system comprising:

a symbol memory for storing a plurality of preselected fields which describe each module of a symbol, the field format for each module including (a) a first field comprising bits describing the state of individual pixels constituting the module, (b) a second field comprising bits indicating in which display writing directions the module may be an entry or exit module, (c) a third field comprising link bits for relating the position of a particular module relative to the other modules of a symbol;

input means for selecting symbols desired for display and the direction in which they are to be written; and symbol generating means connected in circuit with the input means, the memory means, and display means, for detecting the correct entry and exit modules for a selected symbol, dependent upon a selected writing direction, and causing the display of the symbol with its detected entry module adjacent to an exit module of a precedingly displayed symbol.

2. The system set forth in claim 1 wherein the symbol generating means displays a cursor on the display means, the entry module of a selected symbol being located at the position of the cursor during generation of an image.

3. The system set forth in claim 2 wherein the symbol generating means automatically displaces the cursor to a position adjacent the exit module of a selected displayed symbol which is dependent upon the selected write direction.

4. In a method for generating a display image composed of a plurality of interconnected symbols, each of which is in turn composed of a plurality of symbol modules, wherein an entry module of a symbol is displayed adjacent to an exit module of a precedingly displayed symbol, the method comprising the steps:

storing a plurality of preselected fields which describe each module of a symbol, the field format for each module including (a) a first field comprising bits describing the state of individual pixels constituting the module;

(b) a second field comprising bits indicating in which display writing directions the module may be an entry or exit module;

(c) a third field comprising link bits for relating the position of a particular module relative to the other modules of a symbol;

selecting the write direction for the symbols;

selecting symbols desired for display;

detecting the correct entry and exit modules for a selected symbol, dependent upon the selected write direction; and causing the display of the symbol with its detected entry module adjacent to an exit module of a precedingly displayed symbol.

5. The method set forth in claim 4 together with the step of displaying a cursor, the entry module of a selected symbol being located at the position of the cursor during generation of an image.

6. The method set forth in claim 4 together with the step of automatically displacing the cursor to a position adjacent an exit module of a selected displayed symbol which is dependent upon the selected write direction.

* * * * *